US007104824B2

(12) United States Patent
Kuroki

(10) Patent No.: US 7,104,824 B2
(45) Date of Patent: Sep. 12, 2006

(54) CONNECTORS FOR CONNECTING MATING CONNECTORS TO CONNECTION OBJECTS

(75) Inventor: Yoshihide Kuroki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/859,573

(22) Filed: Jun. 3, 2004

(65) Prior Publication Data

US 2004/0248446 A1 Dec. 9, 2004

(30) Foreign Application Priority Data

Jun. 6, 2003 (JP) ..... 2003-161856

(51) Int. Cl.
*H01R 29/00* (2006.01)
*H01R 4/48* (2006.01)

(52) U.S. Cl. ..... 439/188; 439/862

(58) Field of Classification Search ..... 439/188, 439/541.5, 862; 200/51.1
See application file for complete search history.

(56) References Cited

U.S. PATENT DOCUMENTS 5,320,546 A * 6/1994 Weber ..... 439/188
5,693,924 A * 12/1997 Fetterolf et al. ..... 200/51.1
5,741,146 A * 4/1998 Henry et al. ..... 439/188
6,371,796 B1 * 4/2002 Fukuda ..... 439/489
6,390,840 B1 * 5/2002 Wang ..... 439/188
6,764,327 B1 * 7/2004 Yu ..... 439/188

FOREIGN PATENT DOCUMENTS

JP H597074 12/1993

* cited by examiner

*Primary Examiner*—Chandrika Prasad
(74) *Attorney, Agent, or Firm*—Baker Botts L.L.P.

(57) ABSTRACT

In a connector for connecting a mating connector to a connection object, an insulator holds a first contact terminal and a second contact terminal which is removable from the insulator. The first contact terminal has an outer contacting portion to be contacted to the mating connector, a mounting terminal portion to be connected to the connection object, and a spring portion connected between the outer contacting portion and the mounting terminal portion. The spring portion is elastically displaceable within the insulator. The second contact terminal makes contact with the spring portion to serve as a stub terminal when the outer contacting portion is brought into press-contact with the mating connector.

8 Claims, 3 Drawing Sheets

CONNECTORS FOR CONNECTING MATING CONNECTORS TO CONNECTION OBJECTS

This application claims priority to prior Japanese patent application JP 2003-161856, the disclosure of which is incorporated herein by reference.

BACKGROUND OF THE INVENTION

This invention relates to a connector.

Generally, a contacting arrangement of a connector is classified into a stroke type and a butt type.

As an interface connector for a mobile apparatus such as a mobile telephone and a PDA (personal digital assistant), a butt-type contacting arrangement is often used. In a connector utilizing the butt-type contacting arrangement, a signal terminal is required to have a sufficient spring characteristic within a limited space. Therefore, the signal terminal is complicated in shape and a transmission path is increased in length. This results in characteristic impedance mismatching which makes it difficult to adapt the connector to high-speed transmission.

In a high-speed transmission connector, it is ideal that characteristic impedance matching is established uniformly per each signal terminal within the connector. However, due to design limitation, it is difficult to establish such characteristic impedance matching. For example, in a butt-type connector, a spring portion of the signal terminal tends to have a high characteristic impedance because the spring portion can not entirely be surrounded by a dielectric material (insulator). Therefore, it is difficult to match the characteristic impedance as the connector.

Since the characteristic impedance depends upon a sectional area of a transmission path. Therefore, if the sectional area of the transmission path is increased, the characteristic impedance can be lowered. In this case, however, it is difficult to narrow a contact pitch. In addition, it is difficult to set a spring condition providing a sufficient spring characteristic.

Japanese Utility Model Application Publication (JP-U) No. H5-97074 discloses a connector in which a contact spring portion and a terminal portion are fixed to an insulator and, only when the connector is connected to a mating connector, the contact spring portion is pressed by a mating contact to be brought into contact with the terminal portion. In this connector, however, no consideration is made about characteristic impedance matching.

SUMMARY OF THE INVENTION

It is therefore an object of the present invention to provide a connector which is capable of matching a characteristic impedance with a simple structure so as to adapt the connector to high-speed transmission.

It is another object of the present invention to achieve the above-mentioned object in a connector utilizing a butt-type contacting arrangement.

It is still another object of the present invention to provide a high-speed transmission connector which is capable of compensating a characteristic in a high-impedance range.

Other objects of the present invention will become clear as the description proceeds.

According to an aspect of the present invention, there is provided a connector for connecting a mating connector to a connection object, comprising an insulator, a first contact terminal having conductivity and held by the insulator, and a second contact terminal conductivity and held by the insulator to be removable from the insulator, the first contact terminal including an outer contacting portion to be contacted to a the mating connector, a mounting terminal portion to be connected to the connection object, and a spring portion connected between the outer contacting portion and the mounting terminal portion and elastically displaceable within the insulator, the second contact terminal making contact with the spring portion to serve as a stub terminal when the outer contacting portion is brought into press-contact with the mating connector.

DESCRIPTION OF THE PREFERRED EMBODIMENT

Figure 1:
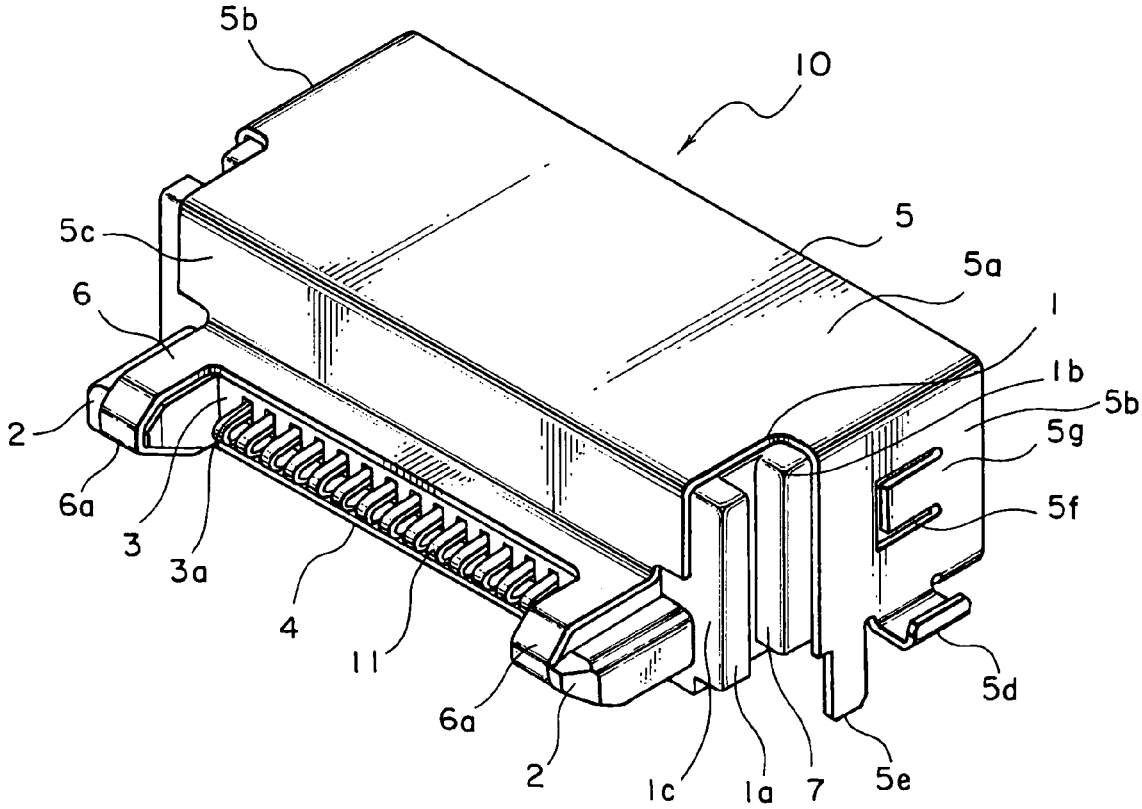
FIG. 1 is a perspective view of a connector according to a first embodiment of the present invention.
Figure 2:
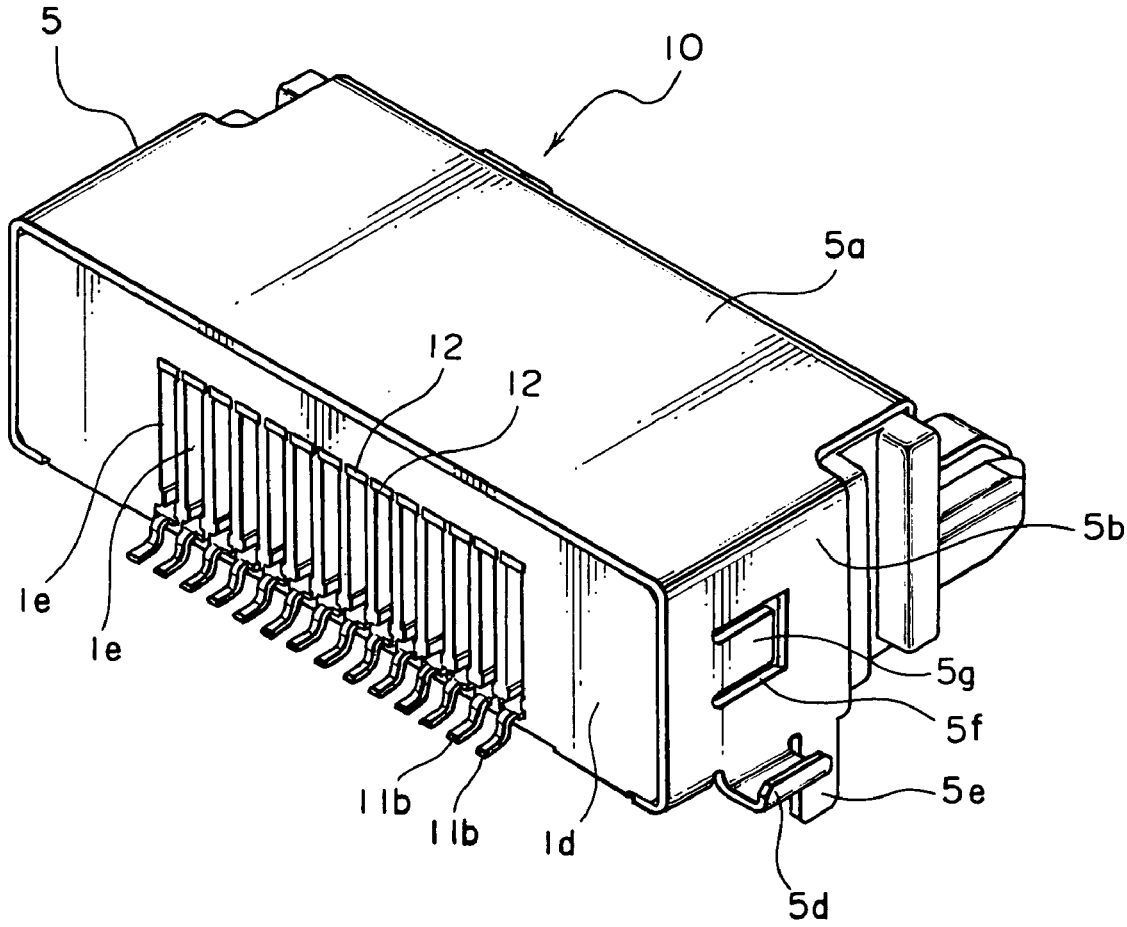
FIG. 2 is a perspective view of the connector illustrated in FIG. 1 as seen in a different direction.

Referring to FIGS. 1 and 2, a connector according to a first embodiment of the present invention is a high-speed transmission connector (hereinafter will simply be referred to as a connector) 10 which can be used as an interface connector in a mobile apparatus such as a mobile telephone or a PDA. The connector 10 is of a butt-type and is for electrically connecting a mating connector to a connection object.

The connector 10 comprises an insulator 1 made of an insulating or dielectric material, such as synthetic resin, and having a box-like shape, a metal shell 5 surrounding the insulator 1, a plurality of first contact terminals 11 accommodated and held in the insulator 1 and used for main signal transmission, and a plurality of second contact terminals 12 adapted to be contacted with the first contact terminals 11, respectively. Each of the first and the second contact terminals 11 and 12 has electrical conductivity and a spring characteristic.

The insulator 1 of a box-like shape has a pair of rectangular cylindrical portions 1*a* formed near left and right ends of a front end face 1*c* and extending in a height direction, a pair of side portions 1*b*, and a pair of protruding portions 2 having a sharp-pointed rectangular cylindrical shape and protruding frontward from a lower part of the front end face 1*c* including the rectangular cylindrical portions 1*a*, and an end portion 4 provided with a plurality of guide holes 3*a* arranged between the protruding portions 2 in parallel to one another in a transversal direction. Between each of the rectangular cylindrical portions 1*a* and each of the side portions 1*b*, a vertical groove 7 is formed.

The shell 5 covers upper and lower surfaces and opposite side surfaces of the insulator 1. Further, the shell 5 has a front end face 5*c* and a pair of shell protruding portions 6 protruding from left and right sides of the front end face 5*c* along the protruding portions 2 to cover the protruding portions 2. Between the shell protruding portions 6, an opening is formed. Through the opening, the end portion 4 is exposed. The shell 5 has a pair of shell side surfaces 5*b* each of which has a protruding portion 5*e* protruding downward to be inserted into a hole formed in a substrate or board 20 as the connection object and a mounting portion 5*d* having an L-shaped section and protruding downward to be brought into contact with an upper surface of the substrate 20. The shell side surface 5*b* is provided with a cut portion 5*g* formed by a cut 5*f*. The cut portion 5*g* serves to prevent misalignment or displacement between the insulator 1 and the shell 2.

Figure 3A:
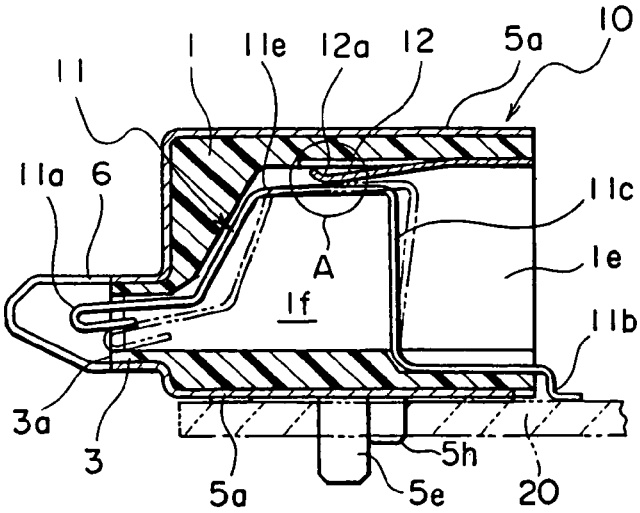
FIG. 3A is a sectional view of the connector illustrated in FIGS. 1 and 2.

As illustrated in FIG. 3A, a plurality of contact receiving portions 1*f* are formed inside the insulator 1 in one-to-one correspondence to the first contact terminals 11. The contact receiving portion 1*f* has an upper surface gradually inclined upward from the guide hole 3*a* towards a rear end and defines an opening 1*e* at the rear end. Each of the first contact terminals 11 is disposed in each of the contact receiving portions 1*f*. The first contact terminal 11 extends through the guide hole 3*a* and the contact receiving portion 1*f* to be exposed from a lower part of the opening 1*e*. Inside the contact receiving portion 1*f*, the second contact terminal 12 is disposed above the first contact terminal 11. The second contact terminals 12 have elasticity and are arranged in one-to-one correspondence to the first contact terminals 11 and extend along a ceiling surface of the contact receiving portion 1*f*.

The first contact terminal 11 has an outer contacting portion 11*a* formed at its one end, a terminal portion 11*b* formed at the other end, and a trapezoidal spring portion 11*c* connecting the contacting portion 11*a* and the terminal portion 11*b*. The contacting portion 11*a* is formed into a U shape extending frontward, bent downward, and extending rearward.

The spring portion 11*c* extends continuously from the contacting portion 11*a* along a front inner wall surface of the contact receiving portion 1*f*, is bent rearward in the vicinity of the ceiling surface, extends rearward along the ceiling surface, is bent downward, and extends to form a rectangle to be butted against a bottom surface of the contact receiving portion 1*f*.

The terminal portion 11*b* is bent rearward from a terminal end of the spring portion 11*c*, exposed outward from the opening 1*e*, bent downward, further bent rearward in parallel to the substrate 20 to be contacted therewith.

Figure 3B:
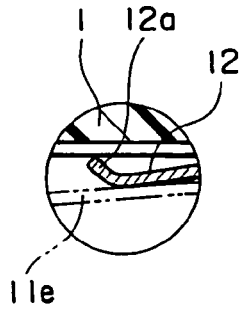
FIG. 3B is an enlarged view of a part A in FIG. 3A.

The second contact terminal 12 extends inward from the opening 1*e* of the contact receiving portion 1*f* along the ceiling surface and is gradually separated from the ceiling surface towards a front side. Further, as is clear from FIG. 3B, the second contact terminal 12 has a front end which is bent upward to form a contact point 12*a* which will be referred as an inner contacting portion. Therefore, the contact point 12*a* is free from the insulator 1.

When the connector 10 is connected to the mating connector, the contacting portion 11*a* is butted against a contact of the mating connector. When the connector 10 is further moved towards the mating connector, the first contact terminal 11 is pressed by the contact of the mating connector to be bent as depicted by two-dot-and-dash lines. As a consequence, the spring portion 11*c* moves upward to bring the contact point 12*a* of the second contact terminal 12 into contact with a contact point 11*e* on an upper surface of the spring portion 11*c*.

As a result, the second contact terminal 12 is electrically connected to the first contact terminal 11 and serves as a so-called stub terminal. Thus, the second contact terminal 12 serves as a stub. Therefore, by matching a characteristic impedance of the spring portion 11*c* of the first contact terminal 11, it is possible to provide a high-speed transmission connector. Thus, by adjusting a terminal length of the second contact terminal 12, a stub length can be freely selected so as to mach the characteristic impedance.

Although the above-mentioned connector 10 is a butt type, the contact receiving portions 1*f* are independently formed in one-to-one correspondence to the contacts. Therefore, the contacts adjacent to each other are prevented from being contacted with each other. Accordingly, it is possible to provide a narrow-pitch connector.

Figure 4A:
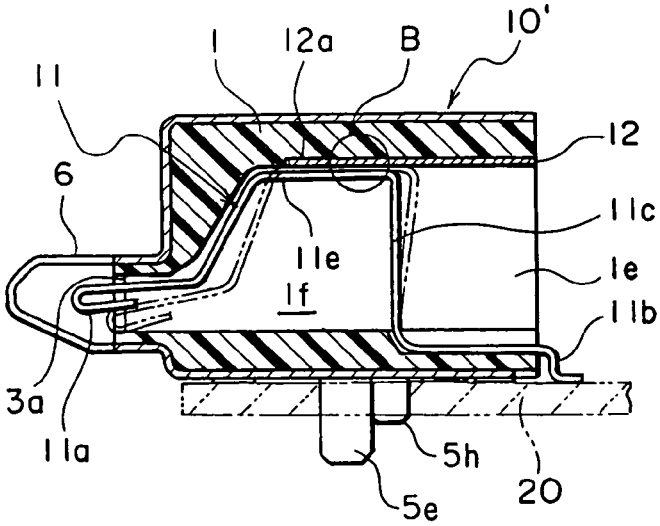
FIG. 4A is a sectional view of a connector according to a second embodiment of the present invention.
Figure 4B:
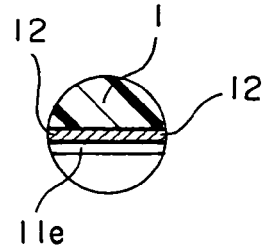
FIG. 4B is an enlarged view of a part B in FIG. 4A.

Referring to FIGS. 4A and 4B in addition to FIGS. 1 and 2, description will be made of a connector 10' according to a second embodiment of the present invention. Similar parts are designated by like reference numerals.

In the connector 10', the second contact terminal 12 has a unique shape. Specifically, the second contact terminal 12 is flat and has a pad characteristic without the spring characteristic. When the connector 10' is connected to the mating connector, the spring portion 11*c* of the first contact terminal 11 is deformed and the contact point 11*e* is moved upward to be brought into contact with a flat lower surface, i.e., a contact pad surface of the second contact terminal 12 fixed to the ceiling surface of the contact receiving portion 1*f*.

In the connector 10' of the above-mentioned structure also, when the contacting portion 11*a* is butted against the contact of the mating connector, the first contact terminal 11 and the second contact terminal 12 are contacted with each other in the manner similar to that mentioned above. Thus, the second contact terminal 12 serves as a stub. Therefore, by matching the characteristic impedance of the spring portion 11*c* of the first contact terminal 11, a high-speed transmission connector can be provided. Specifically, by adjusting the terminal length of the second contact terminal 12, the stub length can freely be selected so that the characteristic impedance is matched.

In the foregoing, the butt-type connector has been described. Not being limited thereto, this invention is similarly applicable to a stroke-type connector.

While this invention has thus far been described in conjunction with the preferred embodiments thereof, it will be readily possible for those skilled in the art to put this invention into practice in various other manners without departing from the scope of this invention.

What is claimed is:

1. A connector for connecting a mating connector to a connection object, comprising:

an insulator;

a first contact terminal having conductivity and held by said insulator; and a second contact terminal having conductivity and held by said insulator to be removable from said insulator, said first contact terminal including:

an outer contacting portion to be contacted to a said mating connector;

a mounting terminal portion to be connected to said connection object; and a U-shaped spring portion opening away from said second contact terminal and connected between said outer contacting portion and said mounting terminal portion and elastically displaceable within said insulator, said second contact terminal curved away from said spring portion of said first contact terminal and making contact with said spring portion to serve as a stub terminal when said outer contacting portion is brought into press-contact with said mating connector.

2. The connector according to claim 1, wherein said outer contacting portion is exposed from said insulator.

3. The connector according to claim 1, wherein said insulator defining a contact receiving portion, said first and said second contact terminals being received in said contact receiving portion.

4. The connector according to claim 3, wherein said second contact terminal has an inner contacting portion facing said spring portion, said inner contacting portion making contact with said spring portion when said outer contacting portion is brought into press-contact with said mating connector.

5. The connector according to claim 4, wherein said inner contacting portion is free from said insulator and has elasticity.

6. The connector according to claim 4, wherein said inner contacting portion extends on said insulator.

7. The connector according to claim 3, wherein said spring portion has a trapezoidal portion with a bottom facing said inner contacting portion.

8. The connector according to claim 1, further comprising a slot formed in said insulator for receiving said second contact terminal.

* * * * *